United States Patent [19]

Agrawal

[11] Patent Number: 5,069,699

[45] Date of Patent: Dec. 3, 1991

[54] TRIPLE DISTILLATION COLUMN NITROGEN GENERATOR WITH PLURAL REBOILER/CONDENSERS

[75] Inventor: Rakesh Agrawal, Allentown, Pa.

[73] Assignee: Air Products and Chemicals, Inc., Allentown, Pa.

[21] Appl. No.: 585,831

[22] Filed: Sep. 20, 1990

[51] Int. Cl.[5] ..... F25J 3/02

[52] U.S. Cl. ..... 62/24; 62/31; 62/39

[58] Field of Search ..... 62/9, 11, 24, 31, 32, 62/38, 39, 44

[56] References Cited

U.S. PATENT DOCUMENTS

| | | | |
|---|---|---|---|
| 4,372,765 | 2/1983 | Tamura et al. | 62/29 |
| 4,400,188 | 8/1983 | Patel et al. | 62/13 |
| 4,410,343 | 10/1983 | Ziemer | 62/29 |
| 4,439,220 | 3/1984 | Olszewski et al. | 62/31 |
| 4,448,595 | 5/1984 | Cheung | 62/31 |
| 4,453,957 | 6/1984 | Pahade et al. | 62/25 |
| 4,464,188 | 8/1984 | Agrawal et al. | 62/13 |
| 4,543,115 | 9/1985 | Agrawal et al. | 62/25 |
| 4,582,518 | 4/1986 | Erikson | 62/25 |
| 4,617,036 | 10/1986 | Suchdeo et al. | 62/11 |
| 4,662,916 | 5/1987 | Agrawal et al. | 62/13 |
| 4,662,917 | 5/1987 | Cormier et al. | 62/13 |
| 4,662,918 | 5/1987 | Agrawal et al. | 62/13 |
| 4,705,548 | 11/1987 | Agrawal et al. | 62/22 |
| 4,916,908 | 4/1990 | Lavin et al. | 62/22 |
| 4,936,099 | 6/1990 | Woodward et al. | 62/24 |

FOREIGN PATENT DOCUMENTS 1215277 12/1970 United Kingdom .

OTHER PUBLICATIONS

M. Ruhemann, "The Separation of Gases", Oxford University Press, 2nd Ed. 1952.

R. E. Latimer, "Distillation of Air", Chem Engr. Prog. 62(2), 35 (1967).

H. Springman, "Cryogenic Principles and Applications" Chem. Engr., p. 59, May 13, 1985.

Pahade and Ziemer, "Nitrogen Production for EOR" 1987 International Cryogenic Materials & Cryogenic Engr. Conf.

J. R. Flower et al., "Medium Purity Oxygen . . . AIChe Symposium Series", vol. 79, p. 4 (1983).

R. Agrawal et al., "Efficient Cryogenic Nitrogen Generator . . . " AIChE Spring National Meeting, Mar. 1990.

R. M. Thorogood, "Large Gas Separation and Liquefaction Plants", Cryogenic Engr., 1986.

*Primary Examiner*—Ronald C. Capossela

*Attorney, Agent, or Firm*—Willard Jones, II; William F. Marsh; James C. Simmons

[57] ABSTRACT

The present invention is a cryogenic process for the production of nitrogen by distilling air in a double column distillation system comprising a high pressure column and a low pressure column associated functionally with an extra high pressure (EHP) distillation column for added nitrogen production. The critical step of the invention is the dual pathway condensation of nitrogen streams in two reboiler/condensers located in the stripping section of the low pressure column to provide condensed high pressure and EHP nitrogen streams that provides liquid reflux to the high pressure columns.

10 Claims, 4 Drawing Sheets

TRIPLE DISTILLATION COLUMN NITROGEN GENERATOR WITH PLURAL REBOILER/CONDENSERS

TECHNICAL FIELD

The present invention is related to a process for the cryogenic distillation of air to produce large quantities of nitrogen.

BACKGROUND OF THE INVENTION

Numerous processes are known in the art for the production of large quantities of high pressure nitrogen by using cryogenic distillation; among these are the following:

The conventional double column process originally proposed by Carl Von Linde and described in detail by several others, in particular, M. Ruhemann in "The Separation of Gases" published by Oxford University Press, Second Edition, 1952; R. E. Latimer in "Distillation of Air" published in Chem. Eng. prog., 62 (2), 35 (1967); and H. Springmann in "Cryogenics Principles and Applications" published in Chem. Eng., pp 59, May 13, 1985; is not useful when pressurized nitrogen is the only desired product. This conventional double column process was developed to produce both pure oxygen and pure nitrogen products. To achieve this end, a high pressure (HP) and a low pressure (LP) column, which are thermally linked through a reboiler/condenser, are used. To effectuate and produce a pure oxygen product stream, the LP column is run at close to ambient pressure. This low pressure of the LP column is necessary to achieve the required oxygen/argon separation with reasonable number of stages of separation.

In the conventional double column process, nitrogen is produced from the top of the LP and HP columns and oxygen from the bottom of the LP column. However, when pure nitrogen is the only desired product and there is no requirement to produce pure oxygen or argon as co-products, this conventional double column process is inefficient. A major source of the inefficiency is due to the fact that the nitrogen/oxygen distillation is relatively easy in comparison to the oxygen/argon distillation and the lower pressure of the LP column (close to ambient pressure) contributes significantly to irreversibility of the distillation process and requires lower pressures for the other process streams, which for a given size of equipment leads to higher pressure drop losses in the plant.

Attempts have been made in the past to improve the performance of this conventional double column process by increasing the pressure of the LP column to 30–60 psia, one such attempt is disclosed by R. M. Thorogood in "Large Gas Separation and Liquefaction Plants" published in Cryogenic Engineering, editor B. A. Hands, Academic Press, London (1986). As a result of increasing the LP column pressure, the HP column pressure is increased to about 100–150 psia. Nitrogen recovery is 0.65–0.72 moles per mole of feed air. Instead of pure oxygen, an oxygen-enriched (60%–75% oxygen concentration) waste stream is withdrawn from the bottom of the LP column. Since this stream is at a pressure higher than the ambient pressure, it can be expanded to produce work and provide a portion of the needed refrigeration for the plant. Also, the LP column does not need large amounts of reboiling to produce a 60%–75% oxygen stream. As a result, the efficiency of the plant is improved by producing a fraction of the nitrogen product at high pressure from the top of the HP column (about 10%–20% of feed air as high pressure nitrogen), however, some major inefficiencies still remain. Since the flowrate of the oxygen-enriched waste stream is essentially fixed (0.25–0.35 moles/mole of feed air), the pressure of the oxygen-enriched waste stream is dictated by the refrigeration requirements of the plant; thus dictating the corresponding pressure of the LP column. Any attempt to further increase the pressure of the LP column to reduce the distillation irreversibilities leads to excess refrigeration across the turboexpander; thus causing overall higher specific power requirements. Another inefficiency in this process is the fact that a large quantity of the oxygen-enriched liquid needs to be reboiled in the LP column reboiler/condenser. These large quantities mean a large temperature variation on the boiling side of the reboiler/condenser compared to the fairly constant temperature on the condensing side for the pure nitrogen; thus contributing to higher irreversible losses across the reboiler/condenser.

U.S. Pat. No. 4,617,036 discloses a process which addresses some of the above described inefficiencies by using two reboiler/condensers. In this arrangement, rather than withdrawing an oxygen-enrich waste stream as vapor from the bottom of LP column, the oxygen-enriched waste stream is withdrawn as a liquid. This liquid stream is then reduced in pressure across a Joule-Thompson (JT) valve and vaporized in a separate external boiler/condenser against a condensing portion of the high pressure nitrogen stream from the top of the HP column. The vaporized oxygen-rich stream is then expanded across a turboexpander to produce work and provide a portion of the needed refrigeration. Reboil of the LP column is provided in two stages, thereby, decreasing the irreversibility across the reboiler/condenser, as is reflected in the fact that for the same feed air pressure, the LP column operates at a higher pressure, about 10–15 psi. As a result, the portion of nitrogen product collected from the top of the LP column is also increased in pressure by the same amount. This leads to a savings in energy for the product nitrogen compressor.

A similar process is disclosed in United Kingdom Pat. No. 1,215,277; a flowsheet derived from this process is shown in FIG. 1. Like U.S. Pat. No. 4,617,036, this process collects an oxygen-rich waste stream as liquid from the bottom of the LP column and vaporizes it in an external reboiler/condenser. The condensing fluid, however, is low pressure nitrogen (40–65 psia) from the top of the LP column. The condensed nitrogen is returned as reflux to the top of the LP column thus decreasing the need for pure nitrogen reflux derived from the HP column. In turn, more gaseous nitrogen can be recovered as product from the top of the HP column (30%–40% of the feed air stream) making the process more energy efficient. Furthermore, the condensation of LP column nitrogen against the oxygen-enriched waste stream allows for an increase in the pressure of both the distillation columns. Which, in turn, makes these columns operate more efficiently and results in higher pressure nitrogen product streams. The increased pressure of these product streams along with the increased pressure of the feed air stream together result in lower pressure drop losses which further contributes to process efficiency.

Another similar process is disclosed in U.S. Pat. No. 4,453,957.

A detailed study of the above two processes is given by Pahade and Ziemer in their paper "Nitrogen Production For EOR" presented at the 1987 International Cryogenic Materials and Cryogenic Engineering Conference.

U.S. Pat. No. 4,439,220 discloses a variation on the process of U.K. Pat. No. 1,215,377 wherein rather than reboiling the LP column with high pressure nitrogen from the top of the HP column, the pressure of the crude liquid oxygen from the bottom of the HP column is decreased and vaporized against the high pressure nitrogen. The vaporized stream forms a vapor feed to the bottom of the LP column. The liquid withdrawn from the bottom of the LP column is the oxygen-enriched waste stream, similar to the process shown in FIG. 1, which is then vaporized against the condensing LP column nitrogen. A drawback of this process is that the liquid waste stream leaving the bottom of the LP column is essentially in equilibrium with the vaporized liquid leaving the bottom of the HP column. The liquid leaving the bottom of the HP column is essentially in equilibrium with the feed air stream and therefore oxygen concentrations are typically about 35%. This limits the concentration of oxygen in the waste stream to below 60% and leads to lower recoveries of nitrogen in comparison to the process of U.K. Pat. No. 1,215,377.

A more efficient process is disclosed in U.S. Pat. No. 4,543,115. In this process, feed air is fed as two streams at different pressures. The higher pressure air stream is fed to the HP column and the lower pressure air is fed to the LP column. The reboiler/condenser arrangement is similar to GB 1,215,377, however, no high pressure nitrogen is withdrawn as product from the top of the HP column and therefore the nitrogen product is produced at a single pressure close to the pressure of the LP column. This process is specially attractive when all the nitrogen product is needed at a pressure lower than the HP column pressure (40–70 psia).

The processes described so far have a large irreversible losses in the bottom section of the LP column, which is primarily due to reboiling large quantities of impure liquid across the bottom LP column reboiler/condenser, leading to substantial temperature variations across the reboiler/condenser on the boiling side; the temperature on the nitrogen condensing side is constant. This, in turn, leads to large temperature differences between condensing and boiling sides in certain sections of reboiler/condenser heat exchanger and contributes to the inefficiency of the system. Additionally, the amount of vapor generated at the bottom of the LP column is more than is needed for the efficient stripping in this section to produce oxygen-enriched liquid (70% $O_2$) from this column. This leads to large changes in concentration across each theoretical stage in the stripping section and contributes to the overall inefficiency of the system.

When an impure oxygen stream is withdrawn from the bottom of a LP column of a double column distillation system, the use of two or more reboilers in the bottom section of the LP column to improve the distillation efficiency has been disclosed by J. R. Flower, et al, in "Medium Purity Oxygen Production and Reduced Energy Consumption in Low Temperature Distillation of Air" published in AICHE Symposium Series Number 224, Volume 79, pp4 (1983) and in U.S. Pat. No. 4,372,765. Both use intermediate reboiler/condensers in the LP column and partially vaporize liquid at intermediate heights of the LP column. The vapor condensed in the top-most intermediate reboiler/condenser is the nitrogen from the top of the HP column. The lower intermediate reboiler/condensers condense a stream from the lower heights of the HP column with the bottom most reboiler/condenser getting the condensing stream from the lowest position of the HP column. In certain instances, the bottom most reboiler/condenser heat duty for reboiling is provided by condensing a part of the feed air stream as is disclosed in U.S. Pat. No. 4,410,343. When nitrogen from the top of the HP column is condensed in an intermediate reboiler/condenser, it can be condensed at a lower temperature and therefore its pressure is lower as compared to its condensation in the bottom most reboiler/condenser. This decreases the pressure of the HP column and hence of the feed air stream and leads to power savings in the main air compressor.

Attempts to extend the above concept of savings for impure oxygen production with multiple reboiler/condensers in the bottom section of the LP column to the nitrogen production cycles have been disclosed in U.S. Pat. Nos. 4,448,595 and 4,582,518. A flow sheet derived from the U.S. Pat. No. 4,448,595 process is shown in FIG. 2. In U.S. Pat. No. 4,448,595, the pressure of the oxygen-rich liquid is reduced from the bottom of the HP column to the LP column pressure and boiled against the high pressure nitrogen from the top of the HP column in a reboiler/condenser. The reboiled vapor is fed to an intermediate location in the LP column. This step operates in principle like obtaining a liquid stream from the LP column of a composition similar to the oxygen-rich liquid from the bottom of the HP column, boiling it and feeding it back to the LP column. However, the situation in U.S. Pat. No. 4,448,595 is worse than feeding oxygen-rich liquid from the bottom of the HP column to the LP column and then through an intermediate reboiler/condenser partially vaporize a portion of the liquid stream to create the same amount of vapor stream in the LP column, thus decreasing the irreversible losses across this reboiler/condenser. Furthermore, feeding oxygen-rich liquid from the HP column to the LP column provides another degree of freedom to locate the intermediate reboiler/condenser at an optimal location in the LP column rather than boiling a fluid whose composition is fixed within a narrow range (approximately 35% oxygen).

U.S. Pat. No. 4,582,518 does exactly the same. In the process, the oxygen-rich liquid is fed from the bottom of the HP column to the LP column and is boiled at an intermediate location of the LP column with an internal reboiler/condenser located at the optimal stage.

On the other hand, U.S. Pat. No. 4,582,518 suffers from another inefficiency. A major fraction of the feed air is fed to the reboiler/condenser located at the bottom of the LP column, however, only a fraction of this air to the reboiler/condenser is condensed. The two phase stream from this reboiler/condenser is fed to a separator. The liquid from this separator is mixed with crude liquid oxygen from the bottom of the HP column and is fed to the LP column. The vapor from this separator forms the feed to the HP column. The process uses only pure nitrogen liquid to reflux both columns; no impure reflux is used. As a result, a large fraction of the nitrogen product is produced at low pressure from the feed air and any benefits gained from the decreased main air compressor pressure is eliminated in the product nitrogen compressors.

Both U.S. Pat. Nos. 4,448,595 and 4,582,518 in following the principles developed for impure oxygen production have succeeded in reducing the pressure of the HP column and therefore the lowering the discharge pressure of the air from the main air compressor. However, they introduce other inefficiencies which substantially increase the proportion of low pressure nitrogen from the cold box. This saves power on the main air compressor but does not provide the lowest energy high pressure nitrogen needed for enhanced oil recovery (pressure generally greater than 500 psia). In short, neither generators described above, considerable work has been done on single column nitrogen generators, which are disclosed in U.S. Pat. Nos. 4,400,188; 4,464,188, 4,662,916; 4,662,917 and 4,662,918. These processes of these patents use one or more recirculating heat pump fluids to provide the boilup at the bottom of the single columns an supplement the nitrogen reflux needs. Use of multiple reboiler/condensers and prudent use of heat pump fluids make these processes quite efficient. However, the inefficiencies associated with the large quantities of recirculating heat pump fluids contribute to the overall inefficiency of the system and these processes are no more efficient than the most efficient double column processes described above from the literature.

Due to the fact that energy requirement of these large nitrogen plants is a major component of the cost of the nitrogen, it is highly desirable to have plants which can economically further improve the efficiency of the nitrogen production.

A 1990 paper entitled "Efficient Cryogenic Nitrogen Generator - An Exergy Analysis" by Agrawal, R. and Woodward, D. W., presented at the American Institute of Chemical Engineers Spring National Meeting in Orlando, in March Of 1990, addresses the utilization of exergy analysis to define inefficiencies in the distillation system components for an efficient cryogenic air separation plant adapted for producing large tonnage quantities of nitrogen. Formulating a definition for column section efficiency coupled with an analysis of overall column efficiency led to quantifying the efficiency of various sections of a distillation system. Two solutions which reduce the exergy loss of cryogenic section by an appreciable percentage were outlined.

The first of these uses two vaporizer-condensers in the bottom section of the low pressure columns, with distillation column exergy losses being reduced when nitrogen is condensed in both of the vaporizer-condensers. The alternate solution involves the importance of returning the condensed air stream to the optimal location in the rectification section. Further, when a limited number of vaporizer-condensers are used in a stripper section, it can be more desirable to condense the same fluid at a different pressure in more than one vaporizer-condenser. While each of the above approaches represents appreciable advances in minimizing exergy losses, the process of the present invention is significantly even more efficient than those taught in the above-identified publications.

SUMMARY OF THE INVENTION

The present invention is a cryogenic process for the production of nitrogen by distilling air in a triple column distillation system comprising a high pressure column, a low pressure column and an discrete associated extra high pressure column. In the process, a compressed air stream is subdivided and cooled to near its dew point and rectified in dual, relatively high pressures columns, producing dual high pressure nitrogen overhead streams and crude oxygen bottom liquids. The one crude oxygen bottoms liquid drawn from the first rectification column is fed to the rectification section of the second high pressure rectification column, with the resulting bottoms liquid being removed from the high pressure column and fed to an intermediate location of the low pressure column for distillation.

Broadly, the compressed and cooled feed air stream is split into at least two major air feed streams; the first substream is sent directly as feed to the bottom of the high pressure column, while the second substream is further boosted in pressure and fed to the bottom of the discrete extra high pressure (EHP) column.

In a first embodiment, two reboiler/condensers are provided in the bottom section of the low pressure column; they are positioned at different heights (spaced apart) with several distillation trays disposed between the two reboiler/condensers.

A high pressure nitrogen stream from the top of the high pressure column is condensed in the uppermost of these two reboiler/condensers, while the lower most reboiler/condenser serves to condense the extra high pressure (EHP) nitrogen overhead stream from the discrete EHP distillation column. The thusly condensed nitrogen streams provide the reflux needed for the three distillation columns; with a portion of the condensed EHP Nitrogen stream providing the reflux for the EHP column, in particular.

The present process configuration creates an EHP nitrogen stream within the "cold box" and avoids the recycle of any nitrogen stream for further refrigeration. This retains the operating flexibility and other process benefits of certain prior art process flowsheets, while avoiding the losses invariably associated with the recycle of a major process stream.

The process of the present invention further comprises removing a portion of the cooled compressed feed air, and expanding the removed portion to generate work. This expanded portion can be cooled and fed to an intermediate location of the low pressure column for distillation, or be warmed and vented from the process.

Another feature of the process of the first embodiment comprises using a third reboiler/condenser located at the top of the low pressure column. In this reboiler/condenser, the oxygen-rich liquid [feed] stream which was withdrawn from the bottom of the low pressure column is boiled against the condensation of a nitrogen stream from the top of the low pressure column. The condensed nitrogen stream is returned as reflux to the low pressure column.

In a second embodiment of the process of the present invention, the configuration of an at least two-way split in the compressed air feed and a third distillation column is retained, including the dissimilar pretreatment of each air substream before they are fed to the differently functioning distillation column. In fact, the process configurations are essentially identical as to all major flow streams, except for the point of introduction of the EHP nitrogen overhead stream to the reboiler/condenser located in the low pressure column.

More specifically, the double-effect distillation column is further modified to employ a third reboiler/condenser in the low pressure column, as will be described. Again, the main compressed air stream is subdivided and cooled to near its dewpoint and rectified to produce dual high pressure nitrogen overheads and crude oxygen bottoms liquids. The combined column bottoms streams are removed from the high pressure column, subcooled, and fed to an internal tray the low pressure column for distillation.

As before, of the two major air flow substreams, the first substream is sent directly to feed the bottom of the high pressure column. Though the second super compressed and cooled air substream is again fed to the bottom of the discrete EHP column, the high pressure nitrogen overflow of the EHP column is treated somewhat differently. This EHP nitrogen stream is fed to an intermediate third reboiler/condenser located in the lower portion of the low pressure column. A portion of the resulting condensed EHP nitrogen stream is combined with the condensed high pressure nitrogen stream from the uppermost reboiler/condenser, and the combined stream is fed to the upper portion of the high pressure column. The thusly condensed two nitrogen streams provide the reflux needs for all three distillation columns, with another portion of the intermediate condensed EHP nitrogen stream also providing the reflux stream for the EHP column, in particular.

In the second embodiment, a portion of the first feed air stream is totally condensed in the bottom-most reboiler/condenser located in the low pressure column and is fed as impure reflux to at least the high pressure column or the low pressure column and is most preferably split between the two columns.

The configurations of these embodiments rely on plural reboiler/condensers in the bottom section of the low pressure column, which serve to decrease the irreversibility associated with prior art distillation systems. Also, the second embodiment condenses a nitrogen stream at an even higher pressure (EHP) than the conventional high pressure column of the art. This process fosters an adjustment to a suitable split in the heat (boiling) duty of the three reboiler/condensers used, while maintaining the nitrogen reflux level needed for most efficient air separation.

DETAILED DESCRIPTION OF THE INVENTION

Figure 1:
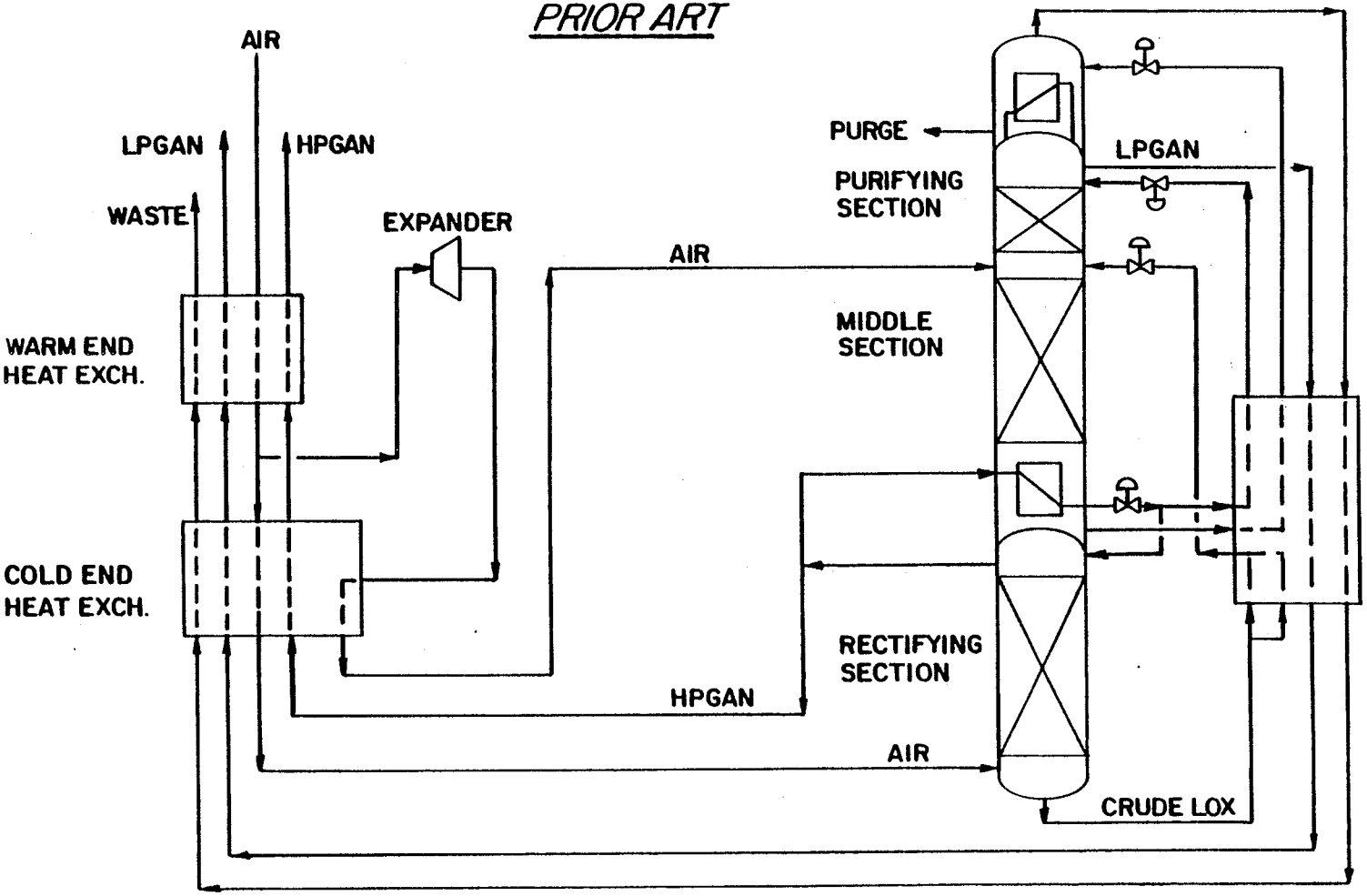
FIG. 1 PRIOR ART
FIG. 1 is a flow diagram of a process derived from the process disclosed in U.K. Pat. No. 1,215,377.
Figure 2:
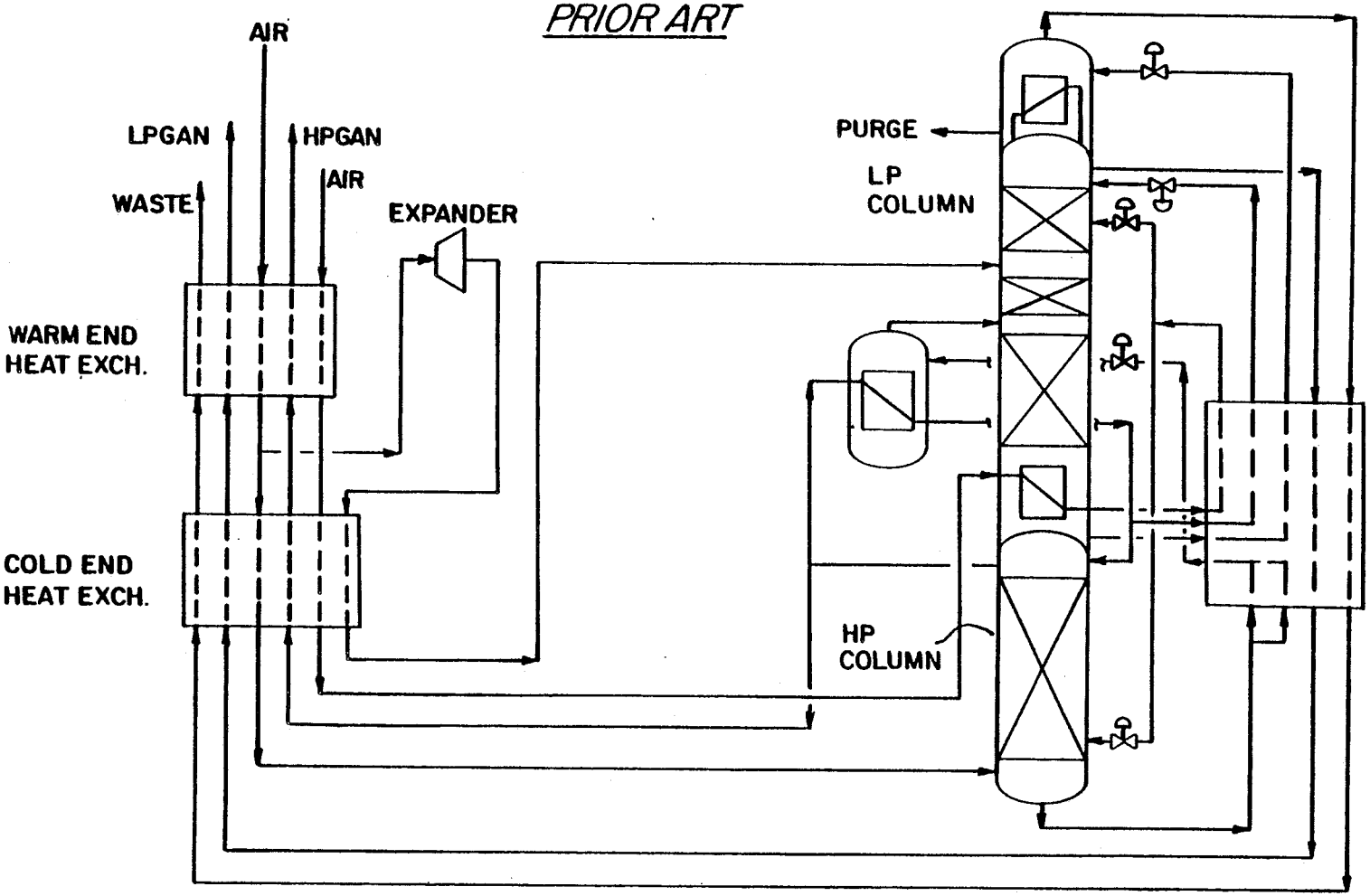
FIG. 2 PRIOR ART
FIG. 2 is a flow diagram of a process derived from the process disclosed in U.S. Pat. No. 4,448,595.

The process of the present invention relates to a nitrogen generator with at least two reboiler/condensers in the bottom section of the LP column and a triple column distillation system. These reboiler/condensers are located at different heights with several distillation trays or stages between them. In both embodiments, the compressed and cooled feed air stream is split into at least two major feedstreams, the first is fed to the high pressure column, and the second is fed to the bottom of the discrete extra high pressure column. In both embodiments, there is a low pressure and a high pressure nitrogen product stream, as well as waste oxygen.

In one embodiment, two reboiler/condensers are provided in the bottom section of the low pressure column; a high pressure nitrogen stream from the top of the high pressure column is condensed in the upper of the two reboiler/condensers, while the lower most reboiler/condenser serves to condense the EHP nitrogen overhead stream from the EHP distillation column. The dual condensed nitrogen streams also provide reflux to all three columns.

In the second embodiment, the two way feed air stream split and the dual pressure nitrogen product streams are retained. However, the double-effect (high pressure/low pressure) distillation column is modified to employ a third reboiler/condenser in the bottom section of the low pressure column. The resulting condensed EHP nitrogen stream is partly combined with the condensed high pressure nitrogen stream from the upper reboiler/condenser and both are fed to the high pressure column. Concurrently, the condensed nitrogen streams provide the reflux needs of all three distillation columns.

The invention in its first embodiment can be explained with reference to FIG. 3. Feed air stream is compressed in a multistage compressor (not seen) to 70–35 psia, cooled with a cooling water and a freon chiller (not seen) and then passed through a molecular sieve bed (not seen) to make it water and carbon dioxide free. This feed air stream is split in to two streams 10 and 12. The flow rate of side stream 12 is 5%–40% of the total compressed air feed flow. The optimal flow rate of stream 12 is 10%–30% of the total feed air flow rate. Other air stream 10 is further cooled in heat exchangers 14 and 24 to give stream 16, which forms the vapor feed at the bottom of the downstream HP column. A portion of feed air stream 10 is fed to a turboexpander 18 as stream 20 and is expanded to provide the needed refrigeration for the plant. The expanded stream 22 is further cooled in cold main heat exchanger 24 as stream 26 fed to a suitable location in the LP column 28. The flowrate of expanded stream 26 is between 5 and 20% of the flow rate of the total feed air stream to the process (the combined feed air of streams 10 and 12), depending on the refrigeration needs. This refrigeration requirement, in turn, depends on the size of the plant and the amount of liquid products.

The main air stream 16 to the HP column 30 is distilled therein to provide a pure nitrogen vapor stream 32 at the top and a oxygen-rich crude liquid oxygen stream 34 at the bottom of this column 30. Crude liquid oxygen stream 34 is further subcooled in heat exchanger 36, is let down in pressure across an isenthalpic Joule-Thompson (JT) valve 37 and is fed as stream 39 to a suitable location in the LP column 28.

The nitrogen vapor stream 32 from the top of the HP column 30 is split into two streams 38 and 40. The flow rate of high pressure nitrogen stream 38 is typically in the range of 5%–50%, with the preferred range being 20%–40% of the total feed air to the process. The high pressure nitrogen stream 38 is then warmed in the main heat exchangers 24 and 14. The warmed stream 42 provides a portion of the combined nitrogen product stream as high pressure nitrogen. Its pressure is within a few psi of the feed air stream 10.

The remaining high pressure nitrogen stream 40 is condensed in an intermediate reboiler/condenser 44, which is located in the stripping section 46 of the LP column 28. A portion of the resulting condensed nitrogen stream 48 is used to provide the reflux to the HP column 30; and the liquid overhead stream 49 from column 30, after subcooling in exchanger 36 is fed at the top of the LP column 28 as reflux stream 50. Flow rate of reflux stream 50 is 0%–40% of the air feed to the HP column.

The several feeds to the LP column 28 are distilled therein to provide a nitrogen rich vapor stream at the top and a oxygen-rich liquid stream 56 at the bottom. The oxygen-rich liquid stream 56 is further subcooled in exchanger 36, let down in pressure, and boiled in a boiler/condenser 58 located at the top of the LP column. The vaporized overhead stream 54 is warmed in the heat exchanger 36 to provide stream 60 which is further warmed in heat exchangers 24 and 14 to provide near ambient pressure oxygen-rich stream 62.

Typically, for plants built for nitrogen product only, this oxygen-rich stream is considered as a waste stream 62, and is vented to the atmosphere. However, in certain instances it can be a useful product stream. A portion of this stream may be used to regenerate the mole sieve bed (not seen) saturated with water and carbon dioxide from the main air feed stream to the plant. Typically, the oxygen concentration in the oxygen-rich liquid stream 56 from the bottom of the LP column 28 will be more than 50%, and optimally in the range of 70%–90%. Its flow rate will be in the range of 23%–40% of the feed air flow to the plant, preferably being around 26%–30% of the (streams 10/12).

A portion of the gaseous nitrogen stream from the top of the LP column 28 is condensed in the top reboiler/condenser 58 and is returned as reflux to the LP column. Another portion is withdrawn as gaseous stream 63, which is warmed in the heat exchanger 36/24/14 to provide a low pressure, gaseous nitrogen stream 64 at close to ambient temperature. This low pressure stream constitutes a portion of the plant nitrogen product streams. Its pressure can be typically in the range of 35–140 psia, with a preferable range of 50–80 psia. Basically, this is also the pressure range of the LP column 28 operation. The flow rate of low pressure nitrogen product stream 64 is 20%–70% of the total feed air stream to the process.

The second portion 12 of the main feed air stream, after boosting in turbocompressor 66, is fed as stream 68 to the heat exchangers 14 and 24 for cooling. The resulting cooled air stream 70 is fed at the bottom of a extra high pressure (EHF) column 72. It is distilled in EHP column 72 to provide a pure, extra high pressure nitrogen stream 74 at the top and an oxygen-rich liquid stream 76 at the bottom. This oxygen rich liquid 76 can either be fed a couple of trays above the bottom tray 78 in the HP column 30, or be mixed with the crude liquid oxygen stream 34 leaving the bottom of the HP column 30. The nitrogen stream 74 is totally condensed in the bottom reboiler/condenser 80, and thus provides the needed boilup to the bottom of the LP column 28.

There is at least more than one tray 81 between this reboiler/condenser 80 and the one 44 above it. A portion of the condensed nitrogen stream from B/C 80 is fed as stream 82 to the top of the EHP column 72. Similarly, another portion of this condensed nitrogen stream from reboiler/condenser 80, is fed at the top of the HP column 30.

Even though not shown, a portion of gaseous nitrogen stream 74 could also be used to provide a product nitrogen stream. The pressure of the EHP column 72 is typically 5–60 psi higher than the HP column 30 pressure. The optimal range being 15–40 psi higher than the HP column pressure, which in turn is within a few psi of the pressure of feed air stream 10.

Though this embodiment shows a separator booster compressor 66 needed for the extra high pressure air stream 68, which is driven by an electric motor, it is possible to drive this compressor 66 with the power output from the turboexpander 18, deployed to supply refrigeration to the plant. In the later case, booster compressor 66 will be mounted on a shaft driven by the turboexpander 18 to provide a compander (tandem compressor/expander) system. This eliminates the need to employ another compressor and also saves on the associated capital cost. However, this coupling presents a constraint, in that the amount of energy available from the turboexpander is limited by the refrigeration needs, and that, in turn, limits the amount of air which can be pressure-boosted in the compressor 66 of the compander.

If the amount of extra high pressure (EHP) air steam 68 needed for the efficient operation of the plant is much in excess of the maximum amount of air available from compressor 66 of the compander array, then the requirement for an electric motor driven booster compressor becomes important. However, as will be shown in the example, for a typical plant this is not the case; so the use of a compander system appears attractive.

Figure 3:
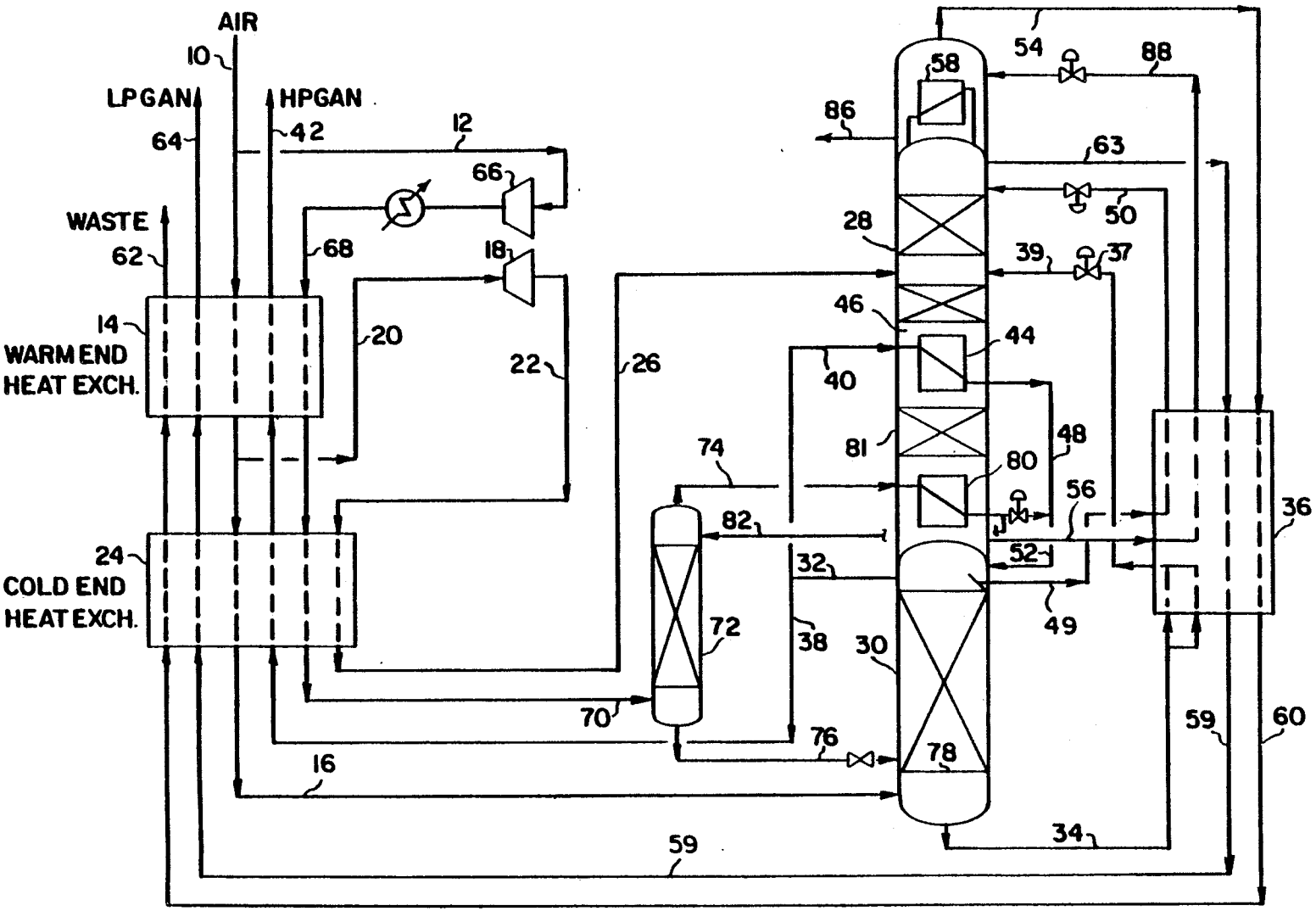
FIGS. 3 and 4 are a flow diagrams of preferred specific embodiments of the process of the present invention.

In the process of FIG. 3, refrigeration is provided by expanding a portion of the feed air stream 20 in a turboexpander that goes to the LP column 28. Alternatively, this air stream 20 could be expanded to a much lower pressure, and then warmed in the heat exchangers 24 and 14, to provide a low pressure stream (not seen). This low pressure stream can then be used to regenerate a bed of molecular sieves (not seen) saturated with water and carbon dioxide from the feed air stream.

It is also possible to expand a stream, other than air, for the refrigeration needs of the plant. For example, an oxygen-rich waste stream 54 from the top boiler/condenser 58 can be expanded in a turboexpander (not seen) to provide the needed refrigeration. Alternatively, a portion of the high pressure nitrogen stream 38 from the top of the HP column 30 could be expanded to the LP column 28 nitrogen pressure level to meet the plant refrigeration requirements.

Figure 4:
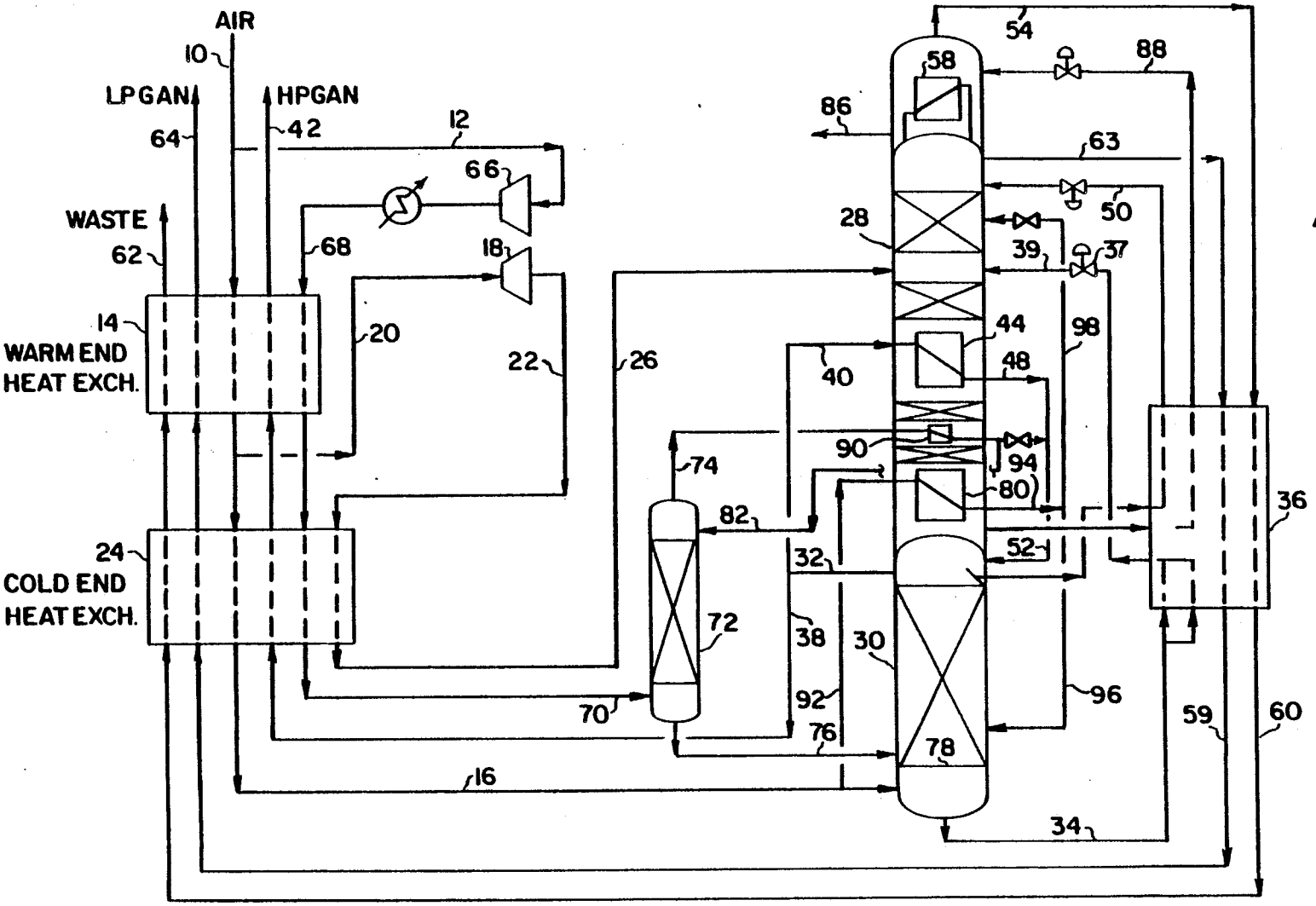

Another embodiment of the present invention is shown in FIG. 4 where a third reboiler/condenser 90 is located in the bottom section of the LP column 28. Similar to the first embodiment, high pressure nitrogen stream 40 from the top of the HP column 30 is still condensed in the top most reboiler/condenser 44, located in the stripping section of the LP column 28. The nitrogen stream 74 from the top of the EHP column 72 is now condensed in the middle reboiler/condenser 90. A portion 92 of the feed air stream 16 to the HP column 30 is now totally condensed in the bottom most reboiler/condenser 80. The totally condensed air stream 94 is split into two streams 96 and 98. These streams are used to provide impure refluxed to both the HP and LP columns, respectively.

The advantage of this process configuration is that by using three reboiler/condensers (44/90/80) in the bottom section of the LP column 28 and by making a judicious balancing of the condensing fluids, such that the distribution of the heat loads in the bottom section of the LP column can be optimized; this leads to further decreases in the main air compressor discharge pressure. This decrease in the main air compressor pressure (not seen) is achieved with minimal detrimental effect on the nitrogen product compressor power. This leads to an overall quite efficient process for nitrogen production in large tonnages at reduced power costs.

The energy advantage of the proposed invention will now be demonstrated through the following example:

EXAMPLE I

Calculations were done to simulate a pure nitrogen stream with an oxygen concentration of about 1 ppm. Both high pressure and low pressure nitrogen streams were produced from the distillation columns, and their proportions were adjusted to minimize the power consumption for each process cycle. In all such calculations, the basis was 100 moles of feed air, and power was calculated as Kwh/short ton of product nitrogen. The final delivery pressure of plant nitrogen was always taken to be 124 psia, and therefore the nitrogen streams from the cold box were compressed in a product nitrogen compressor to provide the desirable pressure. The feed air turboexpander 18 is normally taken to be generator loaded, and credit for the electric power generated is taken in the power calculations.

A number of calculation were done for the first process of FIG. 3 by varying the flowrate of air stream 70 to the bottom of the EHP column 72. This was done to vary the relative boilup between the two reboiler/condensers (44/80) located in the bottom section of the LP column, and to find the minimum in power consumption. The power consumptions for four cases are summarized in Table I.

TABLE I

| | FIG. 1 Prior Art | FIG. 3 Current Invention | | |
|---|---|---|---|---|
| | | Case I | Case II | Case III |
| Moles of Air to EHP Column (Stream 70) per Mole of Total Feed Air to Plant | — | 0.12 | 0.20 | 0.30 |
| Pressure of Stream 10: psia | 137 | 124 | 116 | 109 |
| Nitrogen Produced as HPGAN (Stream 42): % of Air | 28.5 | 31.4 | 32.0 | 32.5 |
| Power Used: Kwh/Ton-GAN | 127.8 | 124.7 | 123.4 | 123.3 |
| Power Savings: % | — | 2.4 | 3.4 | 3.5 |

In Table I, the flowrate of the air stream 70 (FIG. 3) to the bottom of the EHP column 72 is varied from 0.12 moles/mole of the total feed air (streams 10/12) to 0.3 moles/mole of total feed air. As the feed rate to the EHP column 72 is increased, the energy benefit is increased but the power difference between Case-II and Case-III is not appreciable. It is postulated that as air flowrate to the EHP column 72 is increased beyond that given in Case-III, the power consumption will actually start to increase. This is likely since as the flowrate of the air stream to the EHP column 72 is increased, the relative boilup in the bottom most reboiler/condenser of the LP column 28 is increased. There is an optimum split in the boilup duty needed by the two reboiler/condensers (80/44) located in the bottom section of the LP column. When only a little boilup is provided in the bottom most reboiler/condenser 80, then the improvement in distillation is small. On the other hand, when a large fraction of boilup is provided in the bottom most reboiler/condenser 80, then excess vapor is generated at the bottom of the LP column 28 which makes the distillation comparatively inefficient again.

As seen from Table I, this optimum split of the boilup duty is achieved for an air stream flowrate to the EHP column of about 0.2 to 0.3 mols/mole of total plant feed air. The optimum power need is 3.5% lower than the prior art process of FIG. 1. For large tonnage plants, this translates into substantial power savings in variable cost of the nitrogen production.

The relevant process conditions for the preferred case when feed to the EHP column 72 (FIG. 3) is 0.2 moles per mole of total feed air to the cold box is given in Table II.

TABLE II

Process Conditions for Selected Streams for the Process of FIG. 3

| Stream Number | Temperature F. | Pressure psia | Flowrate mol/hr | Composition: mol % Nitrogen | Oxygen | Argon |
|---|---|---|---|---|---|---|
| 10 | 55 | 116 | 80.0 | 78.1 | 21.0 | 0.9 |
| 16 | −267 | 111 | 63.8 | 78.1 | 21.0 | 0.9 |
| 20 | −165 | 114 | 16.2 | 78.1 | 21.0 | 0.9 |
| 26 | −279 | 63 | 16.2 | 78.1 | 21.0 | 0.9 |
| 34 | −272 | 111 | 47.0 | 61.0 | 37.4 | 1.6 |
| 68 | 50 | 138 | 20.0 | 78.1 | 21.0 | 0.9 |
| 70 | −267 | 133 | 20.0 | 78.1 | 21.0 | 0.9 |
| 74 | −276 | 130 | 21.6 | 100.0 | — | — |
| 76 | −268 | 133 | 11.8 | 62.8 | 35.6 | 1.6 |
| 63 | −295 | 60 | 39.0 | 100.0 | — | — |
| 64 | 49 | 54 | 39.0 | 100.0 | — | — |
| 38 | −281 | 109 | 32.0 | 100.0 | — | — |
| 42 | 49 | 105 | 32.0 | 100.0 | — | — |
| 40 | −281 | 109 | 38.9 | 100.0 | — | — |
| 54 | −297 | 18 | 28.8 | 24.8 | 72.1 | 3.1 |
| 62 | 49 | 15 | 28.8 | 24.8 | 72.1 | 3.1 |
| 86 | −297 | 18 | 0.2 | 8.1 | 89.5 | 2.4 |
| 50 | −296 | 109 | 4.9 | 100.0 | — | — |
| 88 | −294 | 64 | 29.0 | 24.7 | 72.3 | 3.0 |

It is also worth noting that when the moles of air to EHP column is about 0.18 moles per mole of total feed air, the air stream 12 in FIG. 3 can be boosted in a compressor, driven entirely by the turboexpander 18 of the plant, i.e., a compander can be used. As observed from Table I, this air flowrate proportion to the EHP column 70 is very close to the optimum point. This gain eliminates the need for a capital expenditure to employ a separate booster compressor 66, driven by an electrical motor, in FIG. 3. Moreover, for large tonnage nitrogen plants, a compander system is often cheaper than a corresponding generator loaded turboexpander.

The present invention has been described with reference to several specific embodiments thereof. These embodiments should not be considered to be a limitation on the scope of the present invention. The scope of the present invention should be ascertained from the following claims.

We claim:

1. A cryogenic process for the production of nitrogen by distilling air in a triple column distillation system consisting essentially of an associated discrete extra pressure column, a high pressure column and a low pressure column, comprising:

a) dividing a compressed feed air stream into a first and second air substreams;

b) cooling the first air substream to near its dew point and rectifying the cooled, first substream in the high pressure column, thereby producing a high pressure nitrogen overhead stream and a crude oxygen bottoms liquid;

c) further compressing and cooling the second air substream to near its dewpoint and feeding the further compressed, cooled, second substream to the bottom section of the extra high pressure distillation column, thereby producing an extra high pressure (EHP) overhead nitrogen stream and an oxygen-rich bottoms liquid stream;

d) condensing the EHP overhead nitrogen stream in a lowermost reboiler/condenser located in the lower portion of the stripping section of the low pressure distillation column;

e) feeding at least a portion of the condensed EHP nitrogen stream to the top section of the extra high pressure column as liquid reflux;

f) feeding the oxygen-rich bottom stream from the high pressure column to the middle section of the low pressure column for distillation;

g) condensing a portion of the high pressure overhead nitrogen stream in an upper reboiler/condenser located in the middle portion of the stripping section of the low pressure column, and returning said condensed portion to the top of the high pressure column to provide liquid reflux to the high pressure column;

h) removing the balance of the high pressure overhead nitrogen stream from the top of the high pressure column, warming this high pressure stream to recover refrigeration and recovering the warmed high pressure stream from the process as a high pressure first nitrogen product, and i) removing a low pressure nitrogen stream from the top of the low pressure column, warming the removed nitrogen stream to recover refrigeration and recovering the warm, low pressure stream from the process as a low pressure second nitrogen product.

2. The process of claim 1 which further comprises removing an oxygen-enriched bottoms liquid from the bottom of the low pressure column; vaporizing the removed, oxygen-enriched bottoms liquid in a reboiler/condenser located in the top of the low pressure column against condensing low pressure nitrogen overhead, thereby creating an oxygen-waste stream, and warming the oxygen-waste stream to recover refrigeration.

3. The process of claim 2 which further comprises expanding the warmed, oxygen-waste stream to produce work, and further warming the expanded oxygen-waste stream to recover any remaining refrigeration.

4. The process of claim 1 which further comprises feeding at least another portion of the condensed EHP nitrogen stream generated in step (d) to the top of the high pressure distillation column to provide additional liquid reflux.

5. A cryogenic process for the production of nitrogen by distilling air in a triple column distillation system consisting essentially of a discrete extra pressure column, a high pressure column and a low pressure column, comprising:

a) dividing a compressed air feed stream into a first and second substream;

b) cooling the first substream to near its dew point and dividing the cooled, first substream into a cooled third and fourth substreams;

c) rectifying at least a portion of the cooled third substream in the high pressure distillation column, thereby producing a high pressure nitrogen overhead stream and a crude oxygen bottoms liquid;

d) further compressing and cooling to near its dewpoint the second substream and feeding same to the bottom section of the extra high pressure distillation column, thereby producing an extra high pressure (EHP) overhead nitrogen stream and an oxygen-rich liquid bottoms stream;

e) condensing the overhead EHP nitrogen stream in an intermediate reboiler/condenser located in the lower part of the stripping section of the low pressure column;

f) feeding at least a portion of this condensed nitrogen stream to the top portion of the extra high pressure column;

g) condensing the portion of the cooled fourth air substream in the bottom most reboiler/condenser located in the lower portion of the LP column;

h) splitting the fully condensed air feed stream produced in step (g) to provide an impure reflux stream for both the high pressure and low pressure columns;

i) removing a low pressure nitrogen stream from the top of the low pressure column, warming the removed nitrogen stream to recover refrigeration, and recovering the warmed low pressure stream from the process as a low pressure first nitrogen product;

j) condensing a portion of the high pressure nitrogen stream from the top of the high pressure column in an uppermost reboiler/condenser located in the lower portion of the low pressure column, to produce a condensed nitrogen stream which is used to provide a liquid reflux to the top of the high pressure column; and k) removing the balance of the high pressure nitrogen stream from the top of the high pressure column, warming the high pressure nitrogen stream balance to recover refrigeration and recovering the warmed high pressure stream from the process as a high pressure second nitrogen product.

6. The process of claim 5 which further comprises removing a portion of the cooled, first compressed feed air stream and expanding the removed portion to generate work.

7. The process of claim 6 which further comprises further cooling the expanded portion and feeding the further cooled expanded portion to an intermediate location of the low pressure column for distillation.

8. The process of claim 6 which further comprises warming the expanded portion to recover refrigeration and venting the warmed, expanded portion.

9. The process of claim 5 which further comprises removing an oxygen-enriched bottoms liquid from the bottom of the low pressure column; vaporizing the removed, oxygen-enriched bottoms liquid in a reboiler/condenser located in the top of the low pressure column against condensing low pressure nitrogen overhead, thereby creating an oxygen-waste stream, and warming the oxygen-waste stream to recover refrigeration.

10. The process of claim 9 which further comprises expanding the partially warmed, oxygen-waste stream to produce work, and further warming the expanded oxygen-waste stream to recover any remaining refrigeration.

* * * * *